United States Patent [19]

Sheratte

[11] 3,983,046

[45]*Sept. 28, 1976

[54] FUNCTIONAL FLUID COMPOSITIONS CONTAINING EPOXY ADDITIVES

[75] Inventor: Martin B. Sheratte, Reseda, Calif.

[73] Assignee: McDonnell Douglas Corporation, Long Beach, Calif.

[ * ] Notice: The portion of the term of this patent subsequent to Jan. 27, 1993, has been disclaimed.

[22] Filed: May 20, 1974

[21] Appl. No.: 471,464

Related U.S. Application Data

[63] Continuation-in-part of Ser. Nos. 400,122, Sept. 24, 1973, Pat. No. 3,957,837, and Ser. No. 449,623, March 11, 1974, Pat. No. 3,935,116.

[52] U.S. Cl. ..... 252/78.5; 252/49.8

[51] Int. Cl.[2] ..... C10M 3/40

[58] Field of Search ..... 252/78, 79, 73, 49.8

[56] References Cited

UNITED STATES PATENTS

| | | | |
|---|---|---|---|
| 2,549,270 | 4/1951 | Watson | 252/78 |
| 2,566,623 | 9/1951 | Moreton | 252/78 |
| 2,636,861 | 4/1953 | Watson | 252/78 |
| 2,659,699 | 11/1953 | George et al. | 252/78 |
| 2,687,377 | 8/1954 | Stewart et al. | 252/78 X |
| 3,637,507 | 1/1972 | Gentit | 252/78 |
| 3,723,320 | 3/1973 | Herber et al. | 252/78 |
| 3,783,132 | 1/1974 | Herber | 252/78 |

*Primary Examiner*—Harris A. Pitlick
*Attorney, Agent, or Firm*—Max Geldin

[57] ABSTRACT

A functional fluid composition consisting essentially of (1) a phosphate ester containing at least two alkyl groups such as tributyl phosphate or dibutyl phenyl phosphate, in combination with a phosphate ester containing at least two aromatic groups, such as n-butyl diphenyl phosphate or tricresyl phosphate, (2) a combination of at least two polyalkylene glycol materials, e.g. two polypropylene glycol ethers having substantially different molecular weights, and (3) a small amount of a mono or poly epoxide, e.g. an alkyl-3,4-epoxycyclohexane carboxylate or a 3,4-epoxycycloalkyl, 3,4-epoxycycloalkyl carboxylate, such epoxides preventing acid build-up in the fluid, and preventing undesirable deposits particularly when such fluid is employed as an aircraft hydraulic fluid.

33 Claims, No Drawings

FUNCTIONAL FLUID COMPOSITIONS CONTAINING EPOXY ADDITIVES

BACKGROUND OF THE INVENTION

This application is a continuation-in-part of my copending applications Ser. No. 400,122, filed Sept. 24, 1973, and now U.S. Pat. No. 3,957,837 and Ser. No. 449,623, filed Mar. 11, 1974 and now U.S. Pat. No. 3,935,116.

The present invention relates to functional fluid compositions having good fire resistance and desirable viscosity characteristics at both high and low temperature, and is particularly directed to functional fluid compositions consisting essentially of certain combinations of phosphate esters and certain combinations of polyalkylene glycol materials, and an epoxide compound of a type which in conjunction with such glycol materials prevents formation of harmful insoluble deposits and prevents acid build-up in the fluid.

Many different types of materials are employed as functional fluids and functional fluids are utilized in a wide variety of applications. Thus, such fluids have been utilized as electronic coolants, diffusion pump fluids, lubricants, damping fluid, power transmission and hydraulic fluids, heat transfer fluids and heat pump fluids. A particularly important application of such functional fluids has been their utilization as hydraulic fluids and lubricants in aircraft, requiring successful operation of such fluids over a wide temperature range, and fire resistant fluids.

Functional and hydraulic fluids employed in many industrial applications and particularly hydraulic fluids for aircraft must meet a number of important requirements. Thus, such hydraulic fluids particularly for aircraft use, should be operable over a wide temperature range, should have good stability at relatively high temperatures and preferably have lubricating characteristics. In addition to having the usual combination of properties making it a good lubricant or hydraulic fluid, such fluid should also have relatively low viscosity at extremely low temperatures and an adequately high viscosity at relatively high temperatures, and must have adequate stability at the high operating temperatures of use. Further, it is of importance that such fluids be compatible with and not adversely affect materials including metals and non-metals such as seals of the system in which the fluid is employed. It is also important in aircraft hydraulic fluids and lubricants that such fluids have as high a firm resistance as possible to prevent ignition if such fluids are accidentally or as result of damage to the hydraulic system, sprayed onto or into contact with surfaces of materials of high temperature. Another important property for application of a hydraulic fluid in aircraft is the provision of a low density fluid to increase pay load.

Hydraulic fluids in commercial jet aircraft are exposed to temperatures ranging from below -40°F. to over 200°F. Within these temperature extremes, it is necessary for the fluid to maintain a reasonably low viscosity when cold, and yet not become too thin when hot.

In presently available commercial functional or hydraulic fluids, phosphate esters are among the most commonly employed base stocks, of which tributyl phosphate and dibutyl phenyl phosphate are widely used components. Both of the latter phosphates are too thin at high temperatures, and their use alone would result in rapid wear of moving parts. Other phosphate esters, such as tricresyl phosphate, for example, which provide the requisite high temperature viscosity become too thick to be useful at low temperatures. Even mixtures of various phosphate esters such as those noted above do not provide the required viscosity characteristics at both low and high temperatures. Accordingly, it has been the practice to achieve the required wide viscosity range required for aircraft hydraulic fluids by adding to a thin base stock, such as phosphate ester or mixtures thereof, a small proportion, e.g., up to 10%, of a polymeric material such as polyalkyl acrylates or methacrylates, whose solubility characteristics in the base stock are chosen so that the polymeric material thickens the fluid more at high temperatures than at low temperatures, and thus functions as a viscosity index (VI) improver.

However, during use, fluids of the above type containing polymers such as the polyalkyl acrylates or methacrylates, tend to decompose due to the shearing forces of the mechanical components encountered in an aircraft hydraulic system, on the fluid, and producing acids. This results in a high degree of acid buildup during use, which is detrimental in causing corrosion of metal surfaces with which the fluid is in contact and also causes further decomposition of the fluid.

U.S. Pat. No. 2,636,861 to Watson discloses aircraft hydraulic fluids comprising a special mixture of a trialkyl phosphate such as tri(2-ethylhexyl) phosphate and a triaryl phosphate containing one or two phenyl groups such as diphenyl cresyl phosphate. It is noted that compositions containing other triaryl phosphates such as tricresyl phosphate are outside the scope of the patent since such compositions tend to be corrosive to metals. The hydraulic fluids of the patent preferably contain polymerized esters of the acrylic acids, particularly polymethacrylates, as viscosity index improvers, and also include a small amount of an epoxide compound, preferably glycidyl aryl ethers, e.g. glycidyl phenyl ether, as a corrosion inhibitor and anti-oxidant. However, it has been found that many monoepoxides of this type are disadvantageous, e.g. in causing skin sensitization problems.

In U.S. Pat. No. 3,637,507 to Gentit improved acid stability of such functinal or hydraulic fluids is achieved by the addition of monoepoxides and particularly certain diepoxides to hydraulic fluids containing a phosphate ester and particularly polymethacrylate and polyacrylate viscosity index improver. However, in currently manufactured fluids of this type, the functionality of the epoxide is severely limited by the reaction which epoxides can have with acrylate and methacrylate viscosity index improver. Thus, although diepoxides such as the 3,4-epoxycyclohexylmethyl 3,4-epoxycyclohexane carboxylate disclosed in the above patent are preferred over the monoepoxide in the above fluids, the concentration of the latter diepoxide must be kept low since the reaction of poly-functional epoxides with acrylate and methacrylate type viscosity index improvers leads to the formation of harmful insoluble deposits. Thus, it is particularly noteworthy that in all of the examples of the above patent, and employing polyalkyl methacrylate viscosity index improver, the concentration of the epoxide components, including the above-noted preferred diepoxide of the patent, is employed in a concentration ranging only from about 0.5 to about 1%. The necessity for using such low concentrations of such diepoxides in order to avoid formation of undesirable deposits in the fluid, due to reaction with acrylate and methacrylate viscosity index improvers, limits the effectiveness of such epoxides in preventing acid build-up.

U.S. Pat. 3,723,320 to Herber et al points out that although the above-noted 3,4-epoxycyclohexyl-3,4-epoxycyclohexane carboxylates are effective as acid acceptors for hydraulic fluids, it confirms that such epoxides in combination with viscosity index improvers such as polyalkyl methacrylates, tend to form harmful deposits. The patent avoids this problem by utilizing instead, certain monoepoxycyclohexyl compounds such as diethyl-4,5-epoxycyclohexane-1,2 dicarboxylate, in an amount of 0.1 to about 5% by weight. However, many of such monoepoxy compounds present skin sensitization problems.

In my copending application Ser. No. 400,122, there is disclosed functional fluid compositions having good fire resistance and desirable viscosity characteristics at both high and low temperatures, consisting essentially of a phosphorus compound, especially a phosphate ester, a polyglycol or a polyglycol ether viscosity index improver, and an epoxide having an epoxide functionality of at least 2, such as an epoxy novolac or 3,4-epoxycyclohexylmethyl, 3,4-epoxycyclohexane carboxylate. Such epoxide can be employed in relatively high concentration to effectively function as an acid absorber to prevent acid buildup, and does not adversely affect the viscosity characteristics of the fluid or react with the polyglycol or polyglycol ether viscosity index improver to form harmful insoluble deposits in the fluid.

DESCRIPTION OF THE INVENTION

According to the present invention, it has now been found that a wide variety of epoxides, including monoepoxides and also polyepoxides having high epoxide functionality, such as those of my copending application Ser. No. 400,122, can be effectively employed in minor amount as acid scavengers or absorbers in functional or hydraulic fluids, employing particularly a combination of certain phosphorus esters and a combination of certain glycol materials, including a glycol material of high molecular weight as defined hereinafter, while at the same time avoiding precipitation of harmful deposits in the fluid, and having substantially less adverse affect upon the viscosity characteristics of the fluid, in the presence of such glycol materials, as compared to the use, e.g. of prior art epoxides, particularly those of high molecular weight such as epoxidized oils, epoxidized soya bean and tall oils, in the presence especially of polymeric acrylate viscosity index improvers.

The epoxides utilized herein are effective particularly when employed in combination with certain mixtures of polyglycols or polyglycol ethers, having different molecular weights, and permitting use of relatively high concentrations of the epoxide, e.g. mono- or polyepoxide, in such fluid for effective control of any acid formed in the fluid, and in controlling or preventing precipitation of any harmful deposits as result of decomposition of the fluid by the presence of such acid. Thus, relatively high concentrations of the epoxides hereof can be employed in phosphate ester-based functional fluids containing certain combinations of glycol materials, as described hereinafter, to prevent acid buildup and avoid formation of deposits in the fluid containing such glycol materials.

However, the presence of glycol based materials tends to lower the autoignition temperature (AIT) of the fluid. In this respect it has been found that the use as an essential base stock component of a phosphate ester containing at least two aromatic groups, and selected from the class consisting of aryl and alkaryl groups, e.g. diphenyl-n-butyl phosphate, hereinafter termed an aromatic phosphate, in combination with a phosphate ester containing at least two aliphatic groups, and selected from the class consisting of alkyl and alkoxyalkyl, e.g. tributyl phosphate or di-n-butyl phenyl phosphate, hereinafter termed an aliphatic phosphate, each particularly in certain amounts noted below, is of particular advantage. In the first place, the presence of the phosphate ester containing at least two aromatic groups has been found unexpectedly to increase or improve the AIT (autoignition temperature) characteristics of the resulting fluid or blend, over the fluid having only a phosphate ester or esters containing at least two alkyl groups, that is, the aliphatic phosphate. This advantage renders unnecessary the use of heavy metal, e.g. selenium or lead, or iodine, organic compounds as AIT enhancers. This is particularly noticeable in blends containing an aliphatic phosphate and including polyglycol ethers such as polyethylene glycol or polypropylene glycol mono- or dibutyl ethers. Such blends generally exhibit AIT values below 700°F. in the absence of either selenium additives, or aromatic phosphates. Thus, in a functional fluid containing e.g. about 75% tributyl phosphate, and about 25% polyalkylene glycol material, by replacing a portion of such tributyl phosphate, e.g. 25% by weight of the fluid, with diphenyl octyl phosphate, the AIT of the resulting blend can be raised as much as 100°F. or more over the fluid containing only the tributyl phosphate.

A further unexpected advantage of the presence of the aromatic phosphate together with the aliphatic phosphate is a marked decrease in the effect of such fluid blend on non-metallic materials, particularly elastomers such as rubber, as compared to fluids containing only an aliphatic phosphate or phosphates. Thus, the amount of rubber swell occuring on contact of such fluid blend of aromatic and aliphatic phosphates with rubber materials such as rubber seals, is markedly reduced as contrasted to the amount of rubber swell produced by contact with fluids containing only aliphatic phosphates. Hence the presence of such aromatic phosphates in the above fluid blends causes a significant improvement in rubber compatibility. This is quite remarkable, since it is known, as pointed out in U.S. Pat. No. 2,469,285 to White, that aromatic compounds are noted for their capacity to cause rubber swelling.

However, the presence of aromatic phosphates, such as tricresyl phospate, in blends together with an aliphatic phosphate, such as tributyl phosphate causes the blend to be less responsive to the viscosity improving characteristics of the polyalkylene glycol component. Thus, it has been found advantageous to incorporate at least two different polyalkylene glycol components, that is at least two polyalkylene glycol materials, preferably at least two polyalkylene glycol ethers, that is, monoethers and/or diethers, having substantially different molecular weights, in the fluid or blend containing both the above-noted aromatic and aliphatic phosphates. The result is that the fluid blend can be more readily designed or tailored so that it has the above-noted desirable low and high temperature viscosity characteristics.

Thus, the functional fluids produced according to the invention can be blended as noted above to have a fire resistance greater than the first resistance of presently employed commercially available hydraulic fluids, and at the same time to have suitably low viscosity at temperatures below −40°F., and down to −65°F., and suitably high viscosity at high temperature of 210°F., and above, and this can be accomplished without incorporating any additional viscosity index improver. By avoiding the necessity for additional viscosity index improver, the functional fluids of the invention do not suffer from the disadvantage noted above, namely, the deterioration of such polymeric additives, e.g. polymeric acrylates or methacrylates, used for viscosity improvement, and accumulation of molecular debris, leading to a shortening of the useful life of the fluid, and at the same time avoids any undesirable reaction of the epoxide with such acrylates or methacrylates. Hence the functional fluids of the present invention have a longer period of usefulness, providing economic advantages including the avoidance of the high cost of such viscosity index improver and the employment of relatively low cost polyalkylene glycol ethers or diethers, in place of a substantial portion of the phosphate ester generally employed in presently available phosphate based aircraft hydraulic fluids.

Also, the functional fluid compositions and blends of the present invention have improved thermal and hydrolytic stability compared with the phosphate ester based fluids currently in use, contributing to a long useful life for the fluid. In addition, the functional fluids according to the present invention have low densities of the order of 1.0 or less, an important property for aircraft hydraulic fluids. The above advantages can be achieved while at the same time improving the flammability characteristics over phosphate ester-type hydraulic fluids currently in use. Also, the functional fluids according to the invention have freedom from corrosivity, wear and deterioration with respect to the metallic and non-metallic components, and the pumps of hydraulic fluid systems, which compare favorably with these characteristics for phosphate type base stock hydraulic fluids presently commercially employed.

Further, in addition to their valuable application as hydraulic fluids for aircraft hydraulic systems, the fluids according to the invention have important application as a hydraulic or functional fluid in industrial and marine fields, particularly in industrial turbine systems.

The aliphatic phosphate ester employed in the functional fluid according to the invention has the general formula:

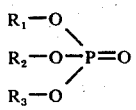

where $R_1$ and $R_2$ each are alkyl, both straight chain and branched chain of from about 3 to about 10 carbon atoms such as n-propyl, n-butyl, n-amyl, n-hexyl, isopropyl, isobutyl, and the like, and alkoxyalkyl having from about 3 to about 8 carbon atoms such as methoxy methyl, methoxy ethyl, ethoxy ethyl, methoxy propyl, and the like, and $R_3$ can be alkyl or alkoxyalkyl as defined above, or aryl such as phenyl and naphthyl, alkaryl such as cresyl, xylyl, ethyl phenyl, propyl phenyl, isopropyl phenyl, and the like, said aryl and alkaryl radicals preferably containing from 6 to about 8 carbon atoms.

Examples of such aliphatic phosphates are the trialkyl phosphates having alkyl groups which are either straight chain or branched chain with from about 3 to about 10 carbon atoms, such as n-propyl, n-butyl, n-amyl and n-hexyl, particularly tri-n-butyl phosphate, tri(2-ethyl hexyl) phosphate and triisononyl phosphate, the straight chain alkyl groups preferably containing from 4 to 6 carbon atoms.

Other examples of such aliphatic phosphate esters are the dialkyl aryl phosphates in which the alkyl groups are either straight chain or branched chain and contain from about 3 to about 10 carbon atoms, such as n-propyl, n-butyl, n-amyl, n-hexyl, isopropyl, isobutyl, isoamyl, and the aryl radicals have from 6 to 8 carbon atoms and can be phenyl, cresyl or xylyl, particularly dialkyl phenyl phosphate including dibutyl phenyl phosphate, butyl amyl phenyl phosphate, butyl hexyl phenyl phosphate, butyl heptyl phenyl phosphate, butyl octyl phenyl phosphate, diamyl phenyl phosphate, amyl hexyl phenyl phosphate, amyl heptyl phenyl phosphate, and dihexyl phenyl phosphate.

The second phosphate ester employed in combination with the above aliphatic phosphate, is an aromatic phosphate. Such aromatic phosphate has the general formula:

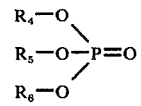

where $R_4$ and $R_5$ are each aryl or alkaryl as defined above, and $R_6$ can be aryl or aralkyl, or alkyl or alkoxyalkyl, as defined above, except that such alkyl can contain from about 3 to about 20 carbon atoms, as illustrated below.

Examples of such aromatic phosphates are triaryl phosphates in which the aryl radicals of such phosphates have from 6 to 8 carbon atoms, that is, may be phenyl, cresyl or xylyl, and in which the total number of carbon atoms in all three of the aryl radicals is from 18 to 24, and preferably wherein the three radicals include at least one cresyl or xylyl radical. Examples of such phosphates include triphenyl, tricresyl, trixylyl, phenyl dicresyl, and cresyl diphenyl phosphates.

Examples of other phosphates also termed herein aromatic phosphates are alkyl diaryl phosphates in which the aryl radicals of such phosphates may have from 6 to 8 carbon atoms and may be phenyl, cresyl or xylyl, and the alkyl radical may have from about 3 to about 20 carbon atoms, examples of which are given above. Examples of the alkyl diaryl phosphates include butyl diphenyl, amyl diphenyl, hexyl diphenyl, heptyl diphenyl, octyl diphenyl, 6-methyl heptyl diphenyl, 2-ethylhexyl diphenyl, decyl diphenyl, decyl dicresyl, tridecyl diphenyl, butyl phenyl cresyl, amyl phenyl xylyl, and butyl dicresyl phosphates.

The above aliphatic and aromatic phosphate esters which can be employed generally are normally liquid between about −65°F. and 210°F., except for triphenyl phosphate. Preferably, the above-noted trialkyl phosphates such as tributyl phosphate or tri-n-hexyl phosphate are employed as the basic aliphatic phosphate, as such phosphates are particularly effective in achieving low viscosity at low temperature. However, the above-noted dialkyl aryl phosphates such as dibutyl phenyl phosphate, also can be employed as the aliphatic phosphate, and such phosphate can be employed in combination with a trialkyl phosphate such as tributyl phosphate.

The aromatic phosphates preferably employed in combination with the aliphatic phosphate component in formulating the above-noted blends, are triaryl phosphates as illustrated above, e.g. tricresyl phosphate, particularly in combination with the above-noted trialkyl phosphates, e.g. tributyl phosphate. However, the above-noted alkyl diaryl phosphate such as butyl diphenyl phosphate or octyl diphenyl phosphate or tridecyl diphenyl phosphate also can be employed, particularly in combination with the above-noted trialkyl phosphate. Mixtures of aromatic phosphates also can be employed as the aromatic phosphate ester component.

Further, a mixture of three of the above aliphatic and aromatic phosphates can be used, e.g. a mixture of dibutyl phenyl, tributyl and triphenyl phosphates, or a mixture of tributyl, trihexyl and butyl diphenyl phosphates. Since triphenyl phosphate is a solid at ambient temperature, it is generally employed in combination with a liquid aliphatic phosphate in sufficient amount to maintain the combination liquid over the desired temperature range of operation of the fluid.

It is noteworthy that the above Watson Patent 2,636,861 avoids the use of tricresyl phosphate, and also makes no mention of the use of alkyl diaryl phosphates or dialkyl aryl phosphates, or combinations thereof, as employed according to the present invention.

The second essential component of the functional fluid according to the invention is a polyalkylene glycol material. The polyalkylene glycol materials employed are compatible with the above-noted phosphate esters.

Although polyalkylene glycols, e.g. polypropylene glycol, can be employed, the preferred polyalkylene glycol materials are those in which one or both of the terminal hydroxy groups have been modified to form ether groups, providing mono- or diether derivatives, or combinations thereof. Thus, the most desirable glycol materials for purposes of the invention are the monoethers and diethers. Particularly satisfactory materials have been found to be the monomethyl ether of polypropylene glycol, the copolymer of ethylene oxide and propylene oxide, monobutyl ether, and the butyl, methyl diether of polypropylene glycol.

The polyalkylene glycol materials employed in the invention composition preferably are substantially hydrophobic materials. It is preferred not to employ those polyalkylene glycol materials that are to any significant extent water miscible and which would accordingly tend to dissolve water at one temperature and crystallize water out at lower temperatures. The molecular weight of the glycol materials can range from about 500 to about 25,000. Also, it is desirable that the polyalkylene glycol component employed be of a type which tends to supercool and to maintain a low viscosity at temperatures down to about −65°F.

However, as previously noted, it has been found advantageous to incorporate two or more glycol materials of the types described above, in combination with a blend of aromatic and aliphatic phosphates, such glycol materials having substantially different molecular weights. Thus, it has been found most desirable to employ a combination of a glycol material, preferably an ether having a low to medium molecular weight, ranging from about 500 to about 2,000, preferably from about 600 to about 1,200, in order to maintain as low a viscosity of the functional fluid as possible at low temperatures, with a high molecular weight glycol material, preferably an ether, the latter material having a molecular weight above about 2,000, generally ranging from about 3,000 to about 25,000.

The ether end groups which preferably are present on the polyalkylene glycol materials are preferably oxyalkyl groups, the alkyl radicals of which can range from 1 to about 8 carbon atoms in length. The longer chain alkyl groups having in excess of 4 carbon atoms, e.g. pentyl, hexyl, heptyl and octyl, are not preferred because polyalkylene glycol ethers of this type have increased viscosity. It is preferred to employ one or more end alkyl groups in the polyalkylene glycol mono- or diether, which have from 1 to 4 carbon atoms. Thus, preferred end alkyl groups are, for example, methyl, ethyl, n-propyl, isopropyl, n-butyl, isobutyl, and the like. It is often desirable that where a diether is employed, one of the end alkyl groups be a methyl or an ethyl radical, while the other end alkyl group of the diether be, for example, a propyl or butyl radical.

The alkylene groups of the polyalkylene glycol material can be an ethylene or propylene group, or mixtures thereof, that is, copolymers containing ethylene and propylene groups. The propylene polymers and ethylene-propylene copolymers, that is, copolymers of ethylene oxide and propylene oxide, are preferred over the ethylene polymers, because of the increased water solubility of the ethylene polymers.

Particularly satisfactory polyalkylene glycol materials for purposes of the invention are the n-butyl methyl, n-butyl ethyl, isobutyl ethyl, n-propyl ether and isopropyl ether diethers of polypropylene glycol, the monomethyl ether of polypropylene glycol and the copolymer of ethylene oxide and propylene oxide, monobutyl ether.

The preferred polyalkylene glycol materials employed in the invention composition can be produced in known manner from the 1,2-alkylene glycols. Thus, for example, polypropylene glycol materials are prepared by reacting 1,2-propylene oxide and the corresponding alkylene glycol to form poly-1,2-propylene glycol derivatives, and one or both terminal hydroxy groups can be modified to provide the above-noted ether groups, either during or after polymerization. The term polypropylene glycol employed in the specification and claims is intended to denote and include the above-noted poly-1,2-propylene glycol derivatives.

As noted above, mixtures of the above polyalkylene glycol materials, e.g. mixtures of polypropylene glycol mono and/or diethers can be used, or mixtures of two copolymers of ethylene oxide and propylene oxide, monobutyl ether, of substantially different molecular weights.

The phosphate esters are employed in amounts sufficient particularly to provide good fire resistance or flammability characteristics of the functional fluid. Further, the phosphates and glycol materials are present in amounts such that the functional fluid composition has a viscosity at −65°F. of not greater than about 6,000 cs, preferably not greater than about 4,200 cs, and a viscosity at 210°F. of not less than 2.25 cs, preferably not less than about 3.0 cs. Generally, the combination or mixture of phosphate esters is employed in an amount ranging from about 15 to about 90%, preferably about 15 to about 70%, by weight of the functional fluid composition. In the mixture of aliphatic and aromatic phosphates, the aliphatic phosphate can be present in an amount ranging from about 10 to about 80%, preferably about 10 to about 60%, and the aromatic phosphate can be present in an amount ranging from about 5 to about 75%, preferably about 5 to about 40%, by weight of the composition. It has often been found desirable to employ a larger amount of the aliphatic phosphate as compared to aromatic phosphate, e.g. a ratio of from 3:2 to 8:1 of aliphatic to aromatic phosphate. However, in some instances a larger amount of aromatic phosphate to aliphatic phosphate can be employed.

The combination or mixture of polyalkylene glycol materials, e.g. polypropylene glycol monoethers or diethers, which can be employed can range from about 10 to about 85%, preferably about 10 to about 70%, by weight of the functional fluid composition. Compositions containing approximately equal weight proportions of the mixture of phosphate esters and the mixture of polyalkylene glycol materials, for example, have been found quite effective. In the mixtures of polyalkylene glycol materials, a low to medium molecular weight glycol material can be used in an amount ranging from about 8 to about 65%, preferably about 10 to about 40%, and a glycol material of high molecular weight in an amount ranging from about 2 to about 25%, preferably about 4 to about 15%, by weight of the composition. In such mixture of glycol materials, generally the polyalkylene glycol material of low to medium molecular weight is employed in larger amount than the glycol material of high molecular weight, e.g. in a ratio of 3:2 to 5:1 of the former to the latter.

In any event, the minimum above-noted proportions of at least 15% of a mixture of phosphate esters, and at least 10% of a mixture of the polyalkylene glycol materials, by weight, are present in the functional fluid.

The description of the above-described phosphate esters and glycol materials is essentially set forth in my above copending application Ser. No. 449,623.

The epoxy compounds incorporated into the phosphate ester-glycol material base stock described above, can be either monoepoxides or polyepoxides.

Thus, effective monoepoxides which can be employed according to the invention are the monoepoxycyclohexyl compounds described in above U.S. Pat. No. 3,723,320. These include compounds having the structure

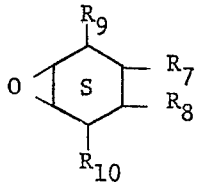

wherein $R_7$ is $-(CH_2)_{0-3}-C(O)OR$, $-C(O)R$, $-OR$, or $-CH_2OR$ where R is an alkyl radical having from 1 to about 12 carbon atoms, $R_8$ is $R_7$, hydrogen, or an alkyl radical having from 1 to about 9 carbon atoms, and $R_9$ and $R_{10}$ are individually hydrogen or an alkyl radical having from 1 to about 4 carbon atoms.

As described above, suitable epoxy materials are the monoepoxycyclohexyl compounds and alkyl-substituted monoepoxycyclohexyl compounds including for example epoxycyclohexane carboxylates, examples of which appear below; dialkyl esters of epoxycyclohexane dicarboxylic acids such as 1. diethyl-4,5-epoxycyclohexane-1,2-dicarboxylate,
2. dibutyl-1-methyl-4,5-epoxycyclohexane-1,2-dicarboxylate,
3. di-(2-ethylhexyl)-4,5-epoxycyclohexane-1,2-dicarboxylate,
4. di-(tridecyl)-4,5-epoxycyclohexane-1,2-dicarboxylate,
5. di-(2-ethylhexyl)-4,5 epoxy-3-methylcyclohexane-1,2, dicarboxylate;

$C_1$ to $C_{18}$ alkyl ethers of 3,4-epoxycyclohexane, particularly the $C_1$ to $C_6$ alkyl ethers, $C_1$ to $C_{18}$ alkyl ethers of 3,4-epoxycyclohexane methanol, particularly the $C_1$ to $C_6$ alkyl ethers; and $C_1$ to $C_{18}$ alkyl ketones of 3,4-epoxycyclohexane, particularly the $C_1$ to $C_6$ alkyl ketones.

Particularly preferred monoepoxy compounds that can be employed in the practice of the present invention are those 3,4-epoxycyclohexane carboxylates having the following structure:

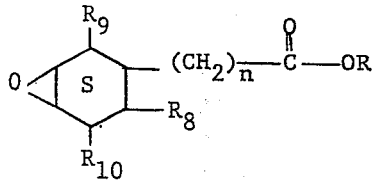

wherein $R_8$ is hydrogen, an alkyl of from 1 to about 9 carbon atoms, or a $$-(CH_2)_n-\overset{O}{\overset{\|}{C}}-OR \text{ group,}$$

$R_9$ and $R_{10}$ are individually hydrogen or an alkyl, of from 1 to about 4 carbon atoms, R is an alkyl of from 1 to about 18 carbon atoms and n is an integer of from 0 to 3.

Representative examples of this class of epoxy compounds include

7. $C_{1-4}$ alkyl-3,4-epoxycyclohexane carboxylate,
8. $C_{1-4}$ alkyl-3,4-epoxycyclohexyl methyl carboxylate,
9. $C_{1-4}$ alkyl-3,4-epoxycyclohexyl ethyl carboxylate,
10. $C_{1-4}$ alkyl-3,4-epoxycyclohexyl propyl carboxylate,
11. methyl-6-methyl-3,4-epoxycyclohexane carboxylate,
12. butyl-2,5-dimethyl-3,4-epoxycyclohexane carboxylate,
13. methyl-6-ethyl-3,4-epoxycyclohexyl methyl carboxylate,
14. butyl-6-isopropyl-3,4-epoxycyclohexyl ethyl carboxylate, and
15. methyl-6-isobutyl-3,4-epoxycyclohexane carboxylate.

It is preferred to employ alkyl esters of at least 5 carbon atoms, that is, where R in the above structural formulae is an alkyl group of from about 5 to about 12 carbon atoms, the octyl esters being particularly preferred. The esters, particularly the monocarboxylates, wherein R is alkyl of from about 1 to about 4 carbon atoms are not preferred, e.g., the methyl and butyl mono carboxylate esters, since these tend to present skin sensitization problems. However, the dibutyl dicarboxylate esters do not appear to be detrimental to the skin. Examples of such preferred epoxy compounds are:

16. 2-ethylhexyl-3,4-epoxycyclohexane carboxylate,
17. octyl-3,4-epoxycyclohexane carboxylate,
18. heptyl-3,4-epoxycylohexane carboxylate,
19. hexyl-3,4-epoxycyclohexane carboxylate,
20. pentyl-3,4-epoxycyclohexane carboxylate,
21. dibutyl-4,5-epoxycyclohexane-1,2-dicarboxylate,
22. dihexyl-4,5-epoxycyclohexane-1,2-dicarboxylate,
23. dioctyl-4,5-epoxycyclohexane-1,2-dicarboxylate.

The advantage of employing polyepoxides, i.e. epoxides having an epoxide functionality of at least 2, lies in their generally greater efficiency in acid absorption over the monoepoxides. This is due to the fact that, as noted above, monoepoxides of relatively high molecular weight usually must be used in functional and hydraulic fluids to avoid skin sensitization and volatility problems. On the other hand, polyepoxides of substantially the same molecular weight contain more epoxy groups, and hence can absorb more acid per unit weight. The ability to employ polyepoxides to obtain this advantage is achieved by the use of polyglycol or polyglycol ether materials, since the latter as previously noted, do not react with the polyepoxide, whereas such polyepoxides do react with acrylate and methacrylate viscosity index improvers to form harmful deposits as noted above.

The polyepoxides employed according to the invention are epoxy compounds containing two or more epoxy groups, and hence having an epoxide functionality of at least 2. Such compounds have the general formula

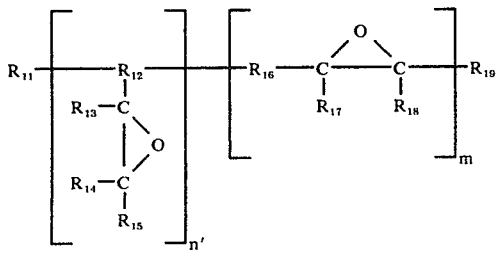

wherein $R_{11}$, $R_{13}$, $R_{14}$, $R_{15}$, $R_{17}$, $R_{18}$ and $R_{19}$ can be hydrogen, alkyl having from 1 to about 8 carbon atoms, and aryl of about 6 to about 8 carbon atoms, and wherein $R_{13}$ and $R_{14}$, or $R_{17}$ and $R_{18}$, together, respectively, can be the carbon atoms necessary to complete a cycloalkyl group of from about 5 to about 6 carbon atoms such as cyclopentyl or cyclohexyl, and $R_{12}$ and $R_{16}$ are divalent or trivalent organic radicals containing from 1 to about 20 carbon atoms, usually 1 to about 8 carbon atoms, including alkylene, such as methylene, ethylene or propylene, arylene, such as phenylene, amino alkylene, for example amino methylene or amino ethylene, amino arylene, such as amino phenylene, ether, including aryl ether, e.g., phenyl ether, alkyl aryl ether; e.g., methyl phenyl ether, and the like, polyether, carboxylic acid ester, polyglycol ether, or dicarboxylic acid radicals; e.g., adipic or sebacic acid radicals.

Examples of alkyl groups which can be employed include straight or branched chain alkyl such as methyl, ethyl, propyl, isopropyl, butyl, isobutyl, amyl, isoamyl, hexyl, ethyl butyl, heptyl, octyl and isooctyl. Such alkyl groups can also be substituted with halogen atoms, e.g., chlorine or fluorine, to form halogenated alkyl radicals.

Examples of aryl radicals which can be employed include phenyl, and substituted phenyl, e.g. cresyl, xylyl, and wherein said aryl groups can be halogenated, e.g. chlorinated or fluorinated phenyl.

The values $n'$ and $m$ in the above general formula individually can range from 0 to 100, but wherein $n'$ plus m equals at least 2.

Thus, there can be employed according to the present invention epoxy novolacs, an example of which are the compounds having the formula

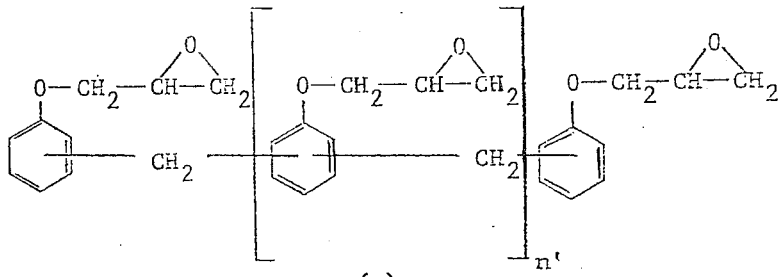

(a)

wherein $n$ can range from 0 to about 10. Examples of epoxy novolacs within the above general formula are the epoxy compounds marketed as Epon 152 and Epon 154, wherein $n$ is between 0 and 1, and $n'$ is between 1 and 2, respectively, and the products marketed as DEN 431 and 438, wherein $n'$ is usually greater than 5, e.g. about 5-10.

Further examples of a polyepoxide which can be employed are the polyglycidyl ethers of phenols and polyphenols such as those set forth below.

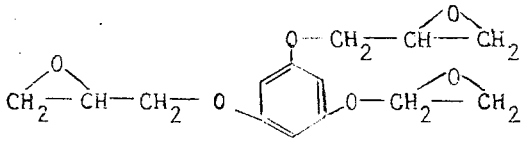

Triglycidyl ether of Phloroglucinol (b)

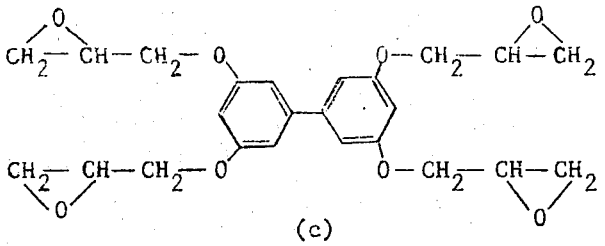

(c)

Tetraglycidyl ether of tetrahydroxy biphenyl

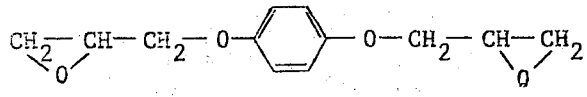

(d)

Diglycidyl ether of hydroquinone

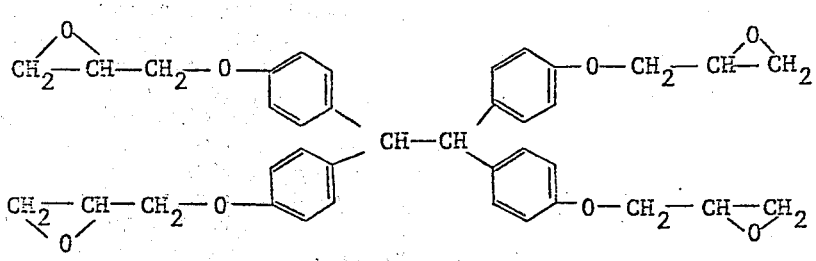

(e)

Tetraglycidyl ether of tetrakis - (4-oxy phenyl) ethane

A material having the above formula is marketed as Epon 1031 Other polyepoxy compounds which can be employed are the poly glycidyl amines, an example of which is noted below:

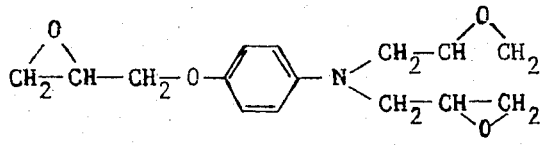

(f)

Triglycidyl p-aminophenol

Also, polyepoxide esters can be employed, an example of which is the 3,4-epoxychohexyl ester of 3,4-epoxycyclohexyl acetic acid having the following formula:

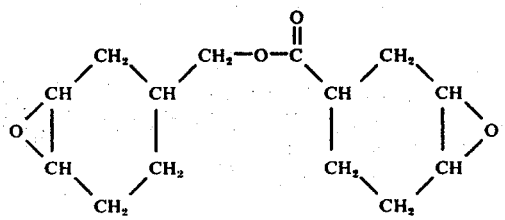

(g)

The material marketed as Unox 221 is understood to be a compound of the above general formula (g).

Examples of other polyepoxy compounds which can be employed are the following:

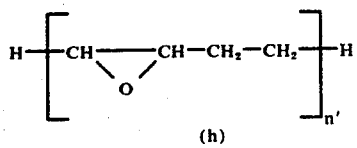

(h)

epoxidized polybutadiene

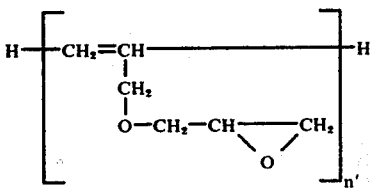

(i)

polyallyl glycidyl ether wherein $n'$ can range from 2 to about 100.

Preferred polyepoxides include epoxy novolacs, polyglycidyl ethers of phenols and polyphenols, polyepoxide esters, epoxidized polybutadiene and polyalyl glycidyl ether, and particularly the compounds (a), (e), (g), and also compounds (h) and (i).

All of the above polyepoxides are known compounds and their method of preparation is likewise known.

The epoxides including the above monoepoxides and polyepoxides generally are employed in an amount ranging from about 0.1 to about 10%, preferably about 1 to about 10%, by weight, and most desireably employing an amount more than 1% of the polyepoxide, particularly about 2 to about 10%.

The description of the above-described polyepoxy compounds is set forth in my above copending application Ser. No. 400,122.

It was found unexpectedly that the above epoxides and polyepoxides function effectively to prevent acid buildup and precipitation of harmful deposits in the fluid, especially at high temperatures, without adversely affecting the desirable low and high temperature viscosity characteristics in the presence of both the high molecular weight polyalkylene glycol material and the low to medium molecular weight polyalkylene glycol material, particularly since such glycol materials are employed in substantial proportions as a base stock component. In addition, it was found further unexpectedly that the epoxide and polyepoxide additives hereof effectively function to reduce or prevent acid buildup and harmful deposits without adversely affecting the enhancement of autoignition temperature as result of employing an aromatic phosphate in combination with an aliphatic phosphate. In addition, when the polyepoxides hereof are employed in amounts of at least 3% by weight, they also function as viscosity index improvers in the fluid containing the combination of phosphate esters and the combination of polyalkylene glycol materials. Moreover, as previously noted, most of the monoepoxides defined above can be employed in such fluid without presenting skin sensitization problems.

It will also be understood that other commonly employed additives such as corrosion inhibitors, oxidation inhibitors, stabilizers, metal deactivators, and the like, such as dialkyl sulfides, benzothazole, 1,2-bis(phenylthio) ethane, phenyl alpha naphthylamine and phenolic oxidation inhibitors, well known as functional fluid additives in the art, can also be incorporated in the functional fluid composition of the invention, in relatively small amounts if desired.

The following are examples illustrating functional fluid compositions according to the invention, such examples being only illustrative and are not intended as limitative of the invention.

EXAMPLE 1

The following composition containing a combination of aliphatic and aromatic phosphate esters was prepared:

| Composition A | |
|---|---|
| Components | Percent by Weight |
| Tributyl phosphate | 49% |
| Santicizer 148 | 25% |
| Ucon LB 285 (a polyglycol) | 14% |
| Ucon 50HB 5100 (a polyglycol) | 6.0% |
| 2-ethylhexyl-3-4-epoxy-cyclohexane carboxylate | 5.0% |
| Others | 1% |
| | 100.0 |

Santicizer 148 is understood to be a mixed alkyl ($C_8$ – $C_{13}$) diphenyl phosphate.

Ucon LB 285 is understood to be the copolymer of ethylene oxide and propylene oxide, monobutyl ether having a molecular weight of approximately 1,000.

Ucon 50HB 5100 is understood to be the copolymer of ethylene oxide and propylene oxide, monobutyl ether, molecular weight 4,000 – 5,000.

Others includes bis(phenylthio) ethane, water and a prefluorinated alkyl sulfonic acid surfactant.

The resulting composition containing a mixture of aliphatic and aromatic phosphates has an AIT (autoignition temperature) of about 800°F.

A fluid Composition B is prepared which is the same as Composition A but containing no epoxide, the relative proportions of the other components in Composition B being the same as for Composition A. Fluid B also has an AIT of about 800°F.

Each of the fluid Compositions A and B are heated at 300°F. for 5 hours, and the acid number of each determined after this treatment according to standard procedure. The fluid Composition B not containing an epoxide developed a relatively high acid number greater than 15, whereas the fluid A containing the above epoxide had an acid number of only 0.3, thereby demonstrating the effectiveness of such epoxide in the fluid Composition A, without adversely affecting other properties of such fluid, including enhanced AIT, both fluid compositions also being free of skin sensitivity and having good high and low temperature viscosity, viscosity at −65°F. for both fluids being of the order of about 4000 centistokes (cs), and viscosity at 210°F. for both fluids being of the order of about 3.0 cs, and both fluids exhibiting minimum rubber swell characteristics.

Fluid Composition A was pump tested for 400 hours at 225°F. in a Vickers Co. variable displacement bent axis aircraft hydraulic pump. At the end of the test the acid number of the fluid according to ASTM-D974 procedure, was only 0.26, and there were no insoluble deposits in the fluid.

EXAMPLE 2

The following Composition C was prepared:

| Composition C | |
|---|---|
| Components | Percent by Weight |
| Tributyl phosphate | 49.5 |
| Santicizer 148 | 24.4 |
| Ucon LB 285 | 14.1 |
| Ucon 50HB 5100 | 5.6 |
| Unox 221 | 4.4 |
| 1,2-bis(phenylthio)-ethane | 0.4 |
| Water | 1.6 |
| | 100.0 |

Unox 221 is understood to be 3,4-epoxycyclohexylmethyl, 3,4-epoxycyclohexane carboxylate.

The properties of the fluid Composition C are closely similar to the properties of fluid Composition A of Example 1 above, particularly with respect to freedom from acidity and from insoluble deposits when in use as a hydraulic fluid in jet aircraft.

EXAMPLE 3

The following compositions containing a combination of phosphate esters, a combination of polyalkylene glycol ethers and a polyepoxy ester according to the invention are also illustrative.

| Composition D | |
|---|---|
| Components | Percent by Weight |
| Dibutyl phenyl phosphate | 75.1 |
| Octyl diphenyl phosphate | 2.0 |
| Ucon LB 285 | 10.0 |
| Ucon 50HB 5100 | 2.0 |
| 2-ethylhexyl-3,4-epoxycyclohexane carboxylate | 10.0 |
| 1,2-bis(phenylthio) ethane | 0.5 |
| water | 0.4 |
| | 100.0% |

| Components | Composition E Percent by Weight |
|---|---|
| Butyl diphenyl phosphate | 8 |
| Tri-n-hexyl phosphate | 55 |
| Ucon DLB-200E | 18 |
| Jeffox OL 2700 | 15.5 |
| Unox 211 | 3.5 |
| | 100.0% |

Ucon DLB-200E is n-butyl-methyl diether of polypropylene glycol (mw. about 1,000). Jeffox OL 2700 is a polypropylene glycol monomethyl ether (mw. about 3,000).

EXAMPLE 4

The following fluids are also illustrative of the invention:

Table 1

| Components | Compositions (parts by weight) F | G |
|---|---|---|
| Tributyl phosphate | 50 | 55 |
| Tricresyl phosphate | 20 | — |
| Dodecyl diphenyl phosphate | — | 20 |
| Ucon LB 285 | 14 | 16 |
| Ucon 50HB 5100 | 6 | 4 |
| Epon 1031 | 2 | — |
| 2-ethylhexyl-3,4-epoxy-cyclohexane carboxylate | 6 | 4 |

EXAMPLE 5

The following fluids are further illustrative of the functional or hydraulic fluids of the invention:

Table 2

| Components | COMPOSITIONS (% by weight) H | J | K | L | M | N | O | P | Q |
|---|---|---|---|---|---|---|---|---|---|
| Dibutyl phenyl phosphate | — | — | — | 45 | — | 15 | — | 15 | — |
| Octyl diphenyl phosphate | — | 20 | — | — | 20 | — | — | — | 15 |
| Tributyl phosphate | 50 | 55 | 25 | — | 40 | — | 50 | 30 | 40 |
| Tricresyl phosphate | 20 | — | — | 20 | — | — | 15 | 25 | 20 |
| Butyl diphenyl phosphate | — | — | 25 | — | — | 25 | — | — | — |
| Tri-n-hexyl phosphate | — | — | 25 | — | — | — | — | — | — |
| Ucon 50 HB 5100 | 6 | 6 | — | — | 10 | — | 10 | 5 | — |
| Ucon DLB 62E | — | — | 14 | 23 | — | — | — | — | 15 |
| Jeffox OL 2700 | — | — | 8 | 6 | — | 20 | — | — | 7 |
| Ucon LB 285 | 17 | 15 | — | — | 20 | 36 | 20 | 22 | — |
| Epon 152 (epoxy compound) | 7 | — | — | — | — | 4 | 5 | — | — |
| Epon 1031 (epoxy compound) | — | 4 | — | — | — | — | — | 3 | — |
| Unox 221 (epoxy compound) | — | — | 3 | — | — | — | — | — | — |
| (3) (epoxy compound) | — | — | — | 6 | — | — | — | — | — |
| (19) (epoxy compound) | — | — | — | — | 10 | — | — | — | 3 |
| | 100 | 100 | 100 | 100 | 100 | 100 | 100 | 100 | 100 |

Ucon DLB 62E is the n-butyl methyl diether of polypropylene glycol (mw. about 700).

It is noted that the epoxide components in Examples 1 to 5 above were employed in relatively high concentration ranging up to 10%, and resulting in maintaining the fluids, containing the combination of phosphate esters and the combination of polyglycol materials clear, with no formation of precipitates or deposits in the fluid.

In addition to their valuable applications as hydraulic fluids for aircraft hydraulic systems, the fluids according to the present invention have important applications as hydraulic functional fluids in industrial and marine fields, particularly in industrial turbine systems.

From the foregoing, it is seen that in accordance with the invention, certain epoxide compounds, described above, are particularly valuable as additives in functional fluids designed particularly for use as hydraulic fluids in jet aircraft, such functional fluids being in the form of a mixture of aliphatic and aromatic phosphate esters, a mixture of polyalkylene glycol materials, particularly a mixture of polypropylene glycol ethers of low to medium molecular weight and of high molecular weight, and a small amount of the above-described epoxide, e.g. mono or polyepoxide, compound. The resulting functional or hydraulic fluids have controlled low acidity and absence of deposits harmful to hydraulic fluid system components, good viscosity characteristics both at low and high temperature, and are substantially free of skin sensitivity problems, such fluids at the same time having good thermal and hydrolytic stability and high autoignition temperature, and having fire resistance and corrosion and pump wear resistance comparable to conventionally employed phosphate ester hydraulic fluids.

While I have described particular embodiments of my invention for the purpose of illustration within the spirit of the invention, various changes and modifications can be made, and hence it will be understood that the invention is not to be taken as limited except by the scope of the appended claims.

I claim:

1. A functional fluid composition consisting essentially of (1) a combination of at least two phosphate esters, one of said phosphate esters containing at least two groups selected from the class consisting of alkyl and alkoxyalkyl, and mixtures thereof, and a second of said phosphate esters containing at least two aromatic groups selected from the class consisting of aryl and alkaryl groups, and mixtures thereof, (2) a combination of at least two polyalkylene glycol materials having terminal groups selected from the class consisting of free hydroxyl and ether groups, said ether groups being oxyalkyl groups wherein the alkyl radicals contain from about 1 to about 8 carbon atoms, said alkylene groups being selected from the class consisting of ethylene and propylene radicals, one of said polyalkylene glycol materials having a molecular weight ranging from about 500 to about 2,000, and a second of said polyalkylene glycol materials having a molecular weight ranging from about 2,000 up to about 25,000, said phosphate esters and said polyalkylene glycol ethers being present in amounts such that said composition has a viscosity at −65°F of not greater than about 6,000 centistokes, and a viscosity at 210°F of not less than 2.25 centistokes, and (3) a small amount of an epoxy compound sufficient to function as an acid scavenger and to prevent precipitation of deposits in said fluid in the presence of said glycol materials, said epoxy compound selected from the group consisting of (A) a compound having the formula

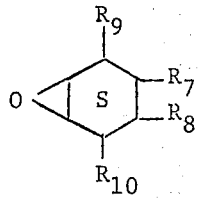

wherein $R_7$ is $-(CH_2)_{0-3}$ -C(O)OR, -C(O)R, -OR, or $-CH_2OR$, where R is an alkyl radical having from 1 to about 12 carbon atoms, $R_8$ is $R_7$, hydrogen, or an alkyl radical having from 1 to about 9 carbon atoms, and $R_9$ and $R_{10}$ are individually hydrogen or an alkyl radical having from 1 to about 4 carbon atoms, and (B) a polyepoxide having the general formula

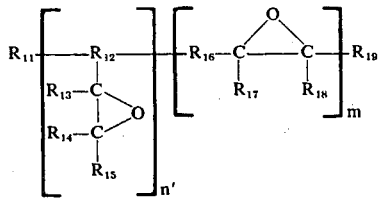

wherein $R_{11}$, $R_{13}$, $R_{14}$, $R_{15}$, $R_{17}$, $R_{18}$ and $R_{19}$ can be a member selected from the group consisting of hydrogen, alkyl having from 1 to about 8 carbon atoms, aryl of from about 6 to about 8 carbon atoms, and wherein $R_{13}$ and $R_{14}$, $R_{17}$ and $R_{18}$, together, respectively, can be the carbon atoms necessary to complete a cycloalkyl group of from about 5 to about 6 carbon atoms, $R_{12}$ and $R_{16}$ are trivalent and divalent organic radicals, respectively, containing from 1 to about 20 carbon atoms, selected from the group consisting of alkyl, aryl, amino alkyl, amino aryl, ether, polyether, carboxylic acid ester and dicarboxylic acid radicals, and wherein $n'$ and $m$ can range from 0 to 100, but wherein $n'$ plus m equals at least 2.

2. A functional fluid composition as defined in claim 1, said phosphate esters and said polyalkylene glycol ethers being present in amounts such that said composition has a viscosity at −65°F. not greater than about 4,200 centistokes and a viscosity at 210°F. not less than about 3.0 centistokes.

3. A functional fluid as defined in claim 1, wherein the epoxide compound is a 3,4-epoxycyclohexane carboxylate having the following structure

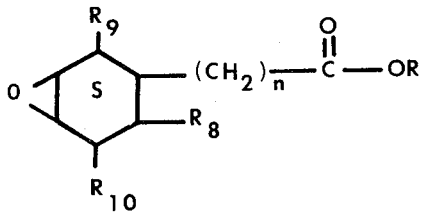

wherein $R_8$ is hydrogen, an alkyl of from 1 to about 9 carbon atoms, or a $$-(CH_2)_n-\overset{\overset{\displaystyle O}{\|}}{C}-OR \text{ group,}$$

$R_9$ and $R_{10}$ are individually hydrogen or an alkyl of from 1 to about 4 carbon atoms, R is an alkyl of from 1 to about 18 carbon atoms and $n$ is an integer of from 0 to 3.

4. A functional fluid composition as defined in claim 1, was combination of phosphate esters being present in an amount ranging from about 15 to about 90%, said combination of polyalkylene glycol materials being present in an amount ranging from about 10 to about 85%, and said epoxy compound being present in an amount ranging from about 0.1 to about 10%, by weight of said composition.

5. A functional fluid composition as defined in claim 1, said combination of phosphate esters being present in an amount ranging from about 15 to about 70%, said combination of polyalkylene glycol materials being present in an amount ranging from about 10 to about 70%, and said epoxy compound being present in an amount ranging from about 2 to about 10%, by weight of said composition.

6. A functional fluid composition as defined in claim 1, said one phosphate ester being present in an amount ranging from about 10 to about 80%, and said second phosphate ester being present in an amount ranging from about 5 to about 75%, said one polyalkylene glycol material being present in an amount ranging from about 8 to about 65%, said second polyalkylene glycol material being present in an amount ranging from about 2 to about 25%, by weight of said composition, and said epoxy compound being present in an amount ranging from about 0.1 to about 10% by weight of said composition.

7. A functional fluid composition as defined in claim 6, said one phosphate ester having the general formula:

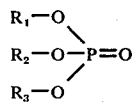

where $R_1$ and $R_2$ are each a member selected from the group consisting of alkyl of from about 3 to about 10 carbon atoms, and alkoxyalkyl having from about 3 to about 8 carbon atoms, and $R_3$ is a member selected from the group consisting of alkyl and alkoxyalkyl, as above defined, aryl and alkaryl, containing from 6 to about 8 carbon atoms, said second phosphate ester having the general formula:

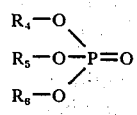

where $R_4$ and $R_5$ are each a member selected frm the group consisting of aryl and alkaryl, containing from 6 to about 8 carbon atoms, and $R_6$ is a member selected from the group consisting of aryl and alkaryl, containing from 6 to about 8 carbon atoms, alkyl of from about 3 to about 20 carbon atoms, and alkoxyalkyl having from about 3 to about 8 carbon atoms.

8. A functional fluid composition as defined in claim 7, wherein said one phosphate ester is selected from the group consisting of dialkyl aryl and trialkyl phosphates, and said second phosphate ester is selected from the group consisting of triaryl and alkyl diaryl phosphates.

9. A functional fluid composition as defined in claim 6, said polyalkylene glycol materials each being a polyalkylene glycol ether having at least one terminal oxyalkyl group wherein the alkyl radical contains from 1 to about 8 carbon atoms.

10. A functional fluid composition as defined in claim 6, said polyalkylene glycol materials being selected from the group consisting of a polypropylene glycol mono- or diether, and a mono- or diether of an ethylene-propylene copolymer, said mono- or diethers having at least one terminal oxyalkyl group wherein the alkyl radicals contain from 1 to about 4 carbon atoms.

11. A functional fluid composition as defined in claim 7, said polyalkylene glycol materials being selected from the group consisting of a polypropylene glycol mono- or diether, and a mono- or diether of an ethylenepropylene copolymer, said mono- or diethers having at least one terminal oxyalkyl groups wherein the alkyl radicals contain from 1 to about 4 carbon atoms.

12. A functional fluid composition as defined in claim 11, said one polyalkylene glycol ether having a molecular weight ranging from about 600 to about 1,200, and said second polyalkylene glycol ether having a molecular weight ranging from about 3,000 to about 25,000.

13. A functional composition as defined in claim 12, wherein said one phosphate ester is selected from the group consisting of dialkyl aryl and trialkyl phosphates, and said second phophate ester is selected from the group consisting of triaryl and alkyl diaryl phosphates.

14. A functional fluid composition as defined in claim 13, said one phosphate ester being present in an amount ranging from about 10 to about 60%, and said second phosphate ester being present in an amount ranging from about 5 to about 40%, said one polyalkylene glycol ether being present in an amount ranging from about 10 to about 40%, and said second polyalkylene glycol ether being present in an amount ranging from about 4 to about 15%, by weight of said composition, and said epoxy compound being present in an amount ranging from about 2 to about 10%, by weight of said composition.

15. A functional fluid composition as defined in claim 12, said one phosphate ester being selected from the group consisting of tributyl phosphate, dibutyl phenyl phosphate and tri-n-hexyl phosphate, and said second phosphate ester being selected from the group consisting of tricresyl phosphate, butyl diphenyl phosphate, octyl diphenyl phosphate and tridecyl diphenyl phosphate.

16. A functional fluid composition as defined in claim 14, said one phosphate ester being selected from the group consisting of tributyl phosphate, dibutyl phenyl phosphate and tri-n-hexyl phosphate, and said second phosphate ester being selected from the group consisting of tricresyl phosphate, butyl diphenylphosphate, octyl diphenyl phosphate and tridecyl diphenyl phosphate.

17. A functional fluid composition as defined in claim 15, said polyalkylene glycol ethers being selected from the group consisting of the n-butyl methyl diether of polypropylene glycol, the monomethyl ether of polypropylene glycol, and the copolymer of ethylene oxide and propylene oxide, monobutyl ether.

18. A functional fluid composition as defined in claim 16, said polyalkylene glycol ethers being selected from the group consisting of the n-butyl methyl diether of polypropylene glycol, the monomethyl ether of polypropylene glycol, and the copolymer of ethylene oxide and propylene oxide, monobutyl ether.

19. A functional fluid composition as defined in claim 18, wherein both said one and said second polyalkylene glycol ethers are each a copolymer of ethylene oxide and propylene oxide, monobutyl ether.

20. A functional fluid composition as defined in claim 7, said epoxy compound being a polyepoxide selected from the group consisting of epoxy novalacs, the polyglycidyl ethers of phenols and polyphenols, polyglycidyl amines, polyepoxide esters, epoxidized polybutadiene and polyallyl glycidyl ether.

21. A functional fluid composition as defined in claim 13, said epoxy compound being a polyepoxide selected from the group consisting of epoxy novalacs, the polyglycidyl ethers of phenols and polyphenols, polyglycidyl amines, polyepoxide esters, epoxidized polybutadiene and polyallyl glycidyl ether.

22. A functional fluid composition as defined in claim 7, wherein said epoxy compound is employed in an amount ranging from about 2 to about 10%, by weight.

23. A functional fluid composition consisting essentially of (1) a combination of at least two phosphate esters, one of said phosphate esters containing at least two groups selected from the class consisting of alkyl and alkoxyalkyl, and mixtures thereof, and a second of said phosphate esters containing at least two aromatic groups selected from the class consisting of aryl and alkaryl groups, and mixtures thereof, (2) a combination of at least two polyalkylene glycol materials having terminal groups selected from the class consisting of free hydroxyl and ether groups, said ether groups being oxyalkyl groups wherein the alkyl radicals contain from 1 to about 8 carbon atoms, said alkylene groups being selected from the class consisting of ethylene and propylene radicals, one of said polyalkylene glycol materials having a molecular weight ranging from about 500 to about 2,000, and a second of said polyalkylene glycol materials having a molecular weight ranging from about 2,000 up to about 25,000, said phosphate esters and said polyalkylene glycol ethers being present in amounts such that said composition has a viscosity at −65°F of not greater than about 6,000 centistokes, and a viscosity at 210°F of not less than 2.25 centistokes, and (3) a small amount of an epoxy compound sufficient to function as an acid scavenger and to prevent precipitation of deposits in said fluid in the presence of said glycol materials, said epoxy compound being a polyepoxide wherein said polyepoxide is a member selected from the group of epoxy compounds having the formulae:

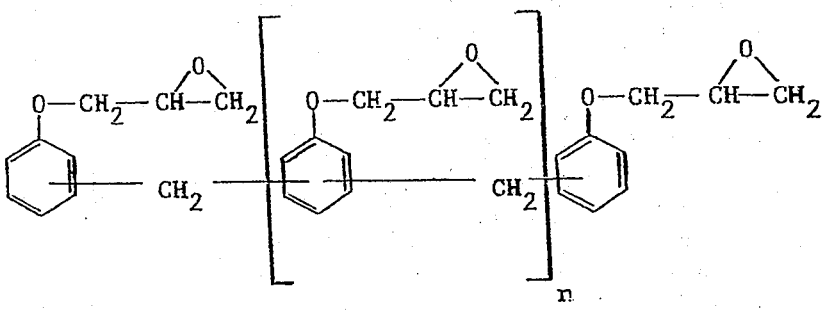

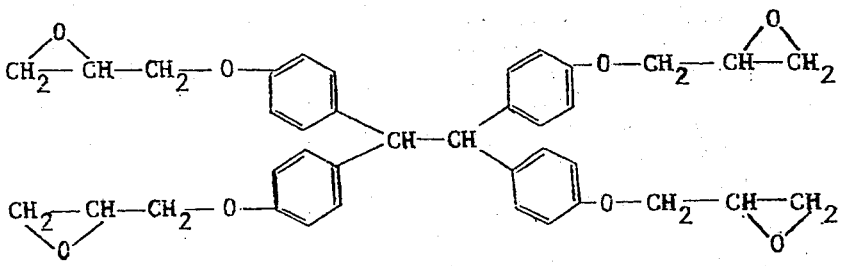

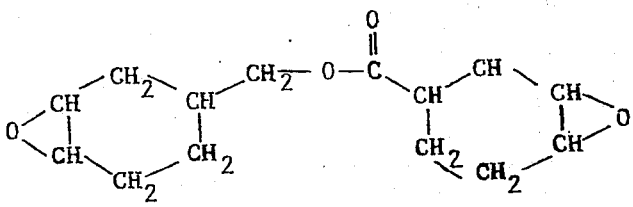

wherein n′ can range from 0 to about 10.

24. A functional fluid composition as defined in claim 23, wherein said one phosphate ester is selected from the group consisting of dialkyl aryl and trialkyl phosphates, and said second phosphate ester is selected from the group consisting of triaryl and alkyl diaryl phosphates, and said polyalkylene glycol materials being selected frm the group consisting of a polypropylene glycol mono- or diether, and a mono- or diether of an ethylene-propylene copolymer, said mono- or diethers having at least one terminal oxyalkyl group wherein the alkyl radicals contain from 1 to about 4 carbon atoms.

25. A functional fluid composition as defined in claim 24, said one phosphate ester being present in an amount ranging from about 10 to about 60%, and said second phosphate ester being present in an amount ranging from about 5 to about 40%, said one polyalkylene glycol ether being present in an amount ranging from about 10 to about 40%, and said second polyalkylene glycol ether being present in an amount ranging from about 4 to about 15%, and said epoxy compound being present in an amount ranging from about 2 to about 10%, by weight of said composition.

26. A functional fluid composition as defined in claim 7, wherein the epoxy compound is a $C_{1-12}$ alkyl 3,4-epoxycyclohexane carboxylate.

27. A functional fluid composition as defined in claim 7, wherein the epoxy compound is $C_{5-12}$ alkyl 3,4-epoxycyclohexane carboxylate.

28. A functional fluid composition as defined in claim 7, wherein the epoxy compound is a di-($C_{1-12}$) alkyl 4,5-epoxycyclohexane -1,2-dicarboxylate.

29. A functional fluid composition as defined in claim 7, wherein the epoxy compound is a di-($C_{5-12}$) alkyl -4,5-epoxycyclohexane -1,2-dicarboxylate.

30. A functional fluid composition as defined in claim 7, wherein the epoxy compound is a $C_{1-12}$ alkyl 3,4-epoxycyclohexyl methyl carboxylate.

31. A functional fluid composition as defined in claim 26, wherein said one phosphate ester is selected from the group consisting of dialkyl aryl and trialkyl phosphates, and said second phosphate ester is selected from the group consisting of triaryl and alkyl diaryl phosphates, said polyalkylene glycol materials being selected from the group consisting of a polypropylene glycol mono- or diether, and a mono- or diether of an ethylene-propylene copolymer, said mono- or diethers having at least one terminal oxyalkyl group wherein the alkyl radicals contain from 1 to about 4 carbon atoms.

32. In a method of operating a hydraulic pressure device wherein a displacing force is transmitted to a displaceable member by means of a hydraulic fluid, the improvement which comprises employing as said fluid a composition as defined in claim 1.

33. In a method of operating a hydraulic pressure device wherein a displacing force is transmitted to a displaceable member by means of a hydraulic fluid, the improvement which comprises employing as said fluid a composition as defined in claim 31.

* * * * *